United States Patent [19]

Sherman

[11] 4,161,421

[45] Jul. 17, 1979

[54] METHOD AND APPARATUS FOR CONTINUOUS OXYGEN BLEACHING OF CELLULOSIC PULP

[75] Inventor: Michael I. Sherman, Glens Falls, N.Y.

[73] Assignee: Kamyr, Inc., Glens Falls, N.Y.

[21] Appl. No.: 832,875

[22] Filed: Sep. 13, 1977

[51] Int. Cl.[2] ..... D21C 7/04; D21C 7/06; D21C 9/10

[52] U.S. Cl. ..... 162/18; 68/5 C; 68/181 R; 162/52; 162/65; 162/237; 162/246; 422/197; 422/233

[58] Field of Search ..... 162/237, 246, 17, 24, 162/65, 233, 52, 18; 23/285; 68/5 C, 181 R; 422/197, 233

[56] References Cited

U.S. PATENT DOCUMENTS

| | | | |
|---|---|---|---|
| 2,007,348 | 7/1935 | Scharmann et al. | 162/24 |
| 2,361,020 | 10/1944 | Gibb | 422/197 |
| 2,662,821 | 12/1953 | Muench | 162/237 |
| 2,680,683 | 6/1954 | Oberghain | 162/237 |
| 3,053,067 | 9/1962 | Frykhult | 68/181 R |
| 3,138,947 | 6/1964 | Johansen | 168/181 R |
| 3,215,591 | 11/1965 | Schayder | 162/246 |
| 3,489,208 | 1/1970 | Munteufel | 23/285 X |
| 3,660,225 | 5/1972 | Verreyne et al. | 162/65 |
| 3,758,379 | 9/1973 | Reinhall | 162/246 |
| 3,963,561 | 6/1976 | Richter | 162/65 |

FOREIGN PATENT DOCUMENTS

| | | | |
|---|---|---|---|
| 671939 | 10/1963 | Canada | 162/65 |
| 2450608 | 8/1975 | Fed. Rep. of Germany | 162/65 |
| 2649633 | 5/1977 | Fed. Rep. of Germany | 162/237 |

OTHER PUBLICATIONS

Casey; *Pulp and Paper; Second Edition, vol. I;* New York, Interscience Publishers, 1960.

*Primary Examiner*—S. Leon Bashore
*Assistant Examiner*—Steve Alvo
*Attorney, Agent, or Firm*—Cushman, Darby & Cushman

[57] ABSTRACT

A method and apparatus for continuous oxygen bleaching of cellulosic pulp is provided utilizing first and second pressurized chambers with a number of tubes in fluid communication with both of first and second chambers. Oxygen bearing fluid is intimately mixed with digested cellulosic pulp and is continuously fed under pressure to the first chamber. Communication is selectively provided between the first and second chambers through at least one of the tubular members to allow passage of pulp from the member to the second chamber. The tubular member through which pulp flows to the second chamber is progressively changed as are the members through which passage is blocked, so that the pulp remains within each tubular member sufficient time to allow oxygen-bleaching thereof without degradation, and passes through the members without channelling. The oxygen bleached pulp is continuously discharged from the second chamber. The passage of pulp through the tubular members may either be downwardly or upwardly. The passage between the blocked tubular members and the second chamber is blocked in the first chamber by a rotating plate, the plate having an aperture rotated into communication with each member in turn, the members disposed in a circle.

22 Claims, 7 Drawing Figures

METHOD AND APPARATUS FOR CONTINUOUS OXYGEN BLEACHING OF CELLULOSIC PULP

BACKGROUND AND SUMMARY OF THE INVENTION

There have been many proposals in the past of methods and apparatus for oxygen bleaching of pulp at various pulp consistencies. For instance, U.S. Pat. No. 3,660,225 increases the consistency of the digested pulp to about 20 to 30 percent, fluffs it, and moves it through successive trays in a reaction vessel establishing the necessary retension time and maintaining small bed heights to prevent pulp compression so that the oxygen may be defused to contact all of the fibers. While such a structure is successful, it is relatively expensive since concentrating apparatus must be employed, expensive rotating structures are utilized, and bed compression can result as the pulp drops from an upper bed to a lower bed. Another type of prior art oxygen bleaching equipment, such as shown in U.S. Pat. Nos. 3,138,947 and 3,963,561, provides for a passage of the pulp and oxygen mixture upwardly in a central tube of the reaction vessel, and then downwardly over the top of the central tube into the annulus between the central tube and the pressure vessel. Severe channelling can take place in such structures, some of the pulp moving through the entire vessel much too rapidly so that there is only partial bleaching thereof, while other portions moving through the vessel much too slowly with resultant degradation of the cellulose fibers.

According to the present invention, the retention time for each individual portion of the pulp within the reacting vessel is more accurately controlled, channelling being substantially reduced, while a continuous feed and discharge are maintained. According to the method of the present invention, oxygen bleaching of cellulosic pulp at super atmospheric pressure and temperature is effected utilizing a first pressurized chamber, a plurality of generally prismatic hollow members (i.e. tubes) in fluid communication with the first chamber at one end thereof, and a second pressurized chamber, at least some of the hollow members in fluid communication with the second chamber at the other ends thereof. The method comprises the steps of mixing oxygen bearing fluid with digested cellulosic pulp and continuously feeding the pulp under pressure to the first chamber. Then, selective communication is provided between the first and second chambers through at least one of the members to allow pulp passage from the member to the second chamber, while blocking passage between others of the members and the second chamber. The method comprises further steps of progressively changing at least one member through which pulp passes to the second chamber and the members through which passage is blocked, so pulp remains within each member sufficient time to allow oxygen-bleaching thereof without degradation, and passes through the members without channeling, and continuously discharging the oxygen bleached pulp from the second chamber. The pulp normally has a consistency of about 6 to 15 percent, and passage between the first and second chambers may be either vertically upwardly or vertically downwardly.

Oxygen-bleaching apparatus according to the present invention comprises a pressurized first chamber adapted to receive digested cellulosic pulp and including an inlet, and means for adding an oxygen bearing fluid to digested cellulosic pulp and mixing the oxygen with the pulp before passage into the inlet. A plurality of generally prismatic hollow members each having first and second ends are also provided, each in fluid communication at the first end thereof with the first chamber and extending therefrom. The apparatus further includes a pressurized second chamber adapted to receive pulp therein, the second chamber being in fluid communication with at least some of the said members at the second end thereof, the second chamber including an outlet for oxygen bleached pulp; means for selectively providing passage of digested cellulosic pulp mixed with oxygen through at least one of the members from at least one member to the second chamber while preventing passage of the pulp between others of the plurality of members and the second chamber; and means for progressively moving the passage providing and blocking means so that it provides communication between each member and the second chamber in turn, so that pulp remains within each member sufficient time to allow oxygen bleaching thereof without degradation. The members are preferably a plurality of tubes extending vertically between the first and second members and disposed in one or more circles, with the passage providing and blocking means including a rotatable plate having an aperture therein for in-turn communication with each of the tubes during rotation of the plate. The rotation of the plate may be continuous or it may be indexed from tube to tube, with rapid movement between the tubes. A scraper is provided in the second chamber to facilitate discharge of the oxygen bleached pulp through the outlet.

It is the primary object of the present invention to provide a relatively inexpensive method and apparatus for continuous oxygen bleaching of pulp, without channelling. This and other objects of the invention will become clear from an inspection of the detailed description of the invention, and from the appended claims.

DETAILED DESCRIPTION OF THE INVENTION

Figure 1:
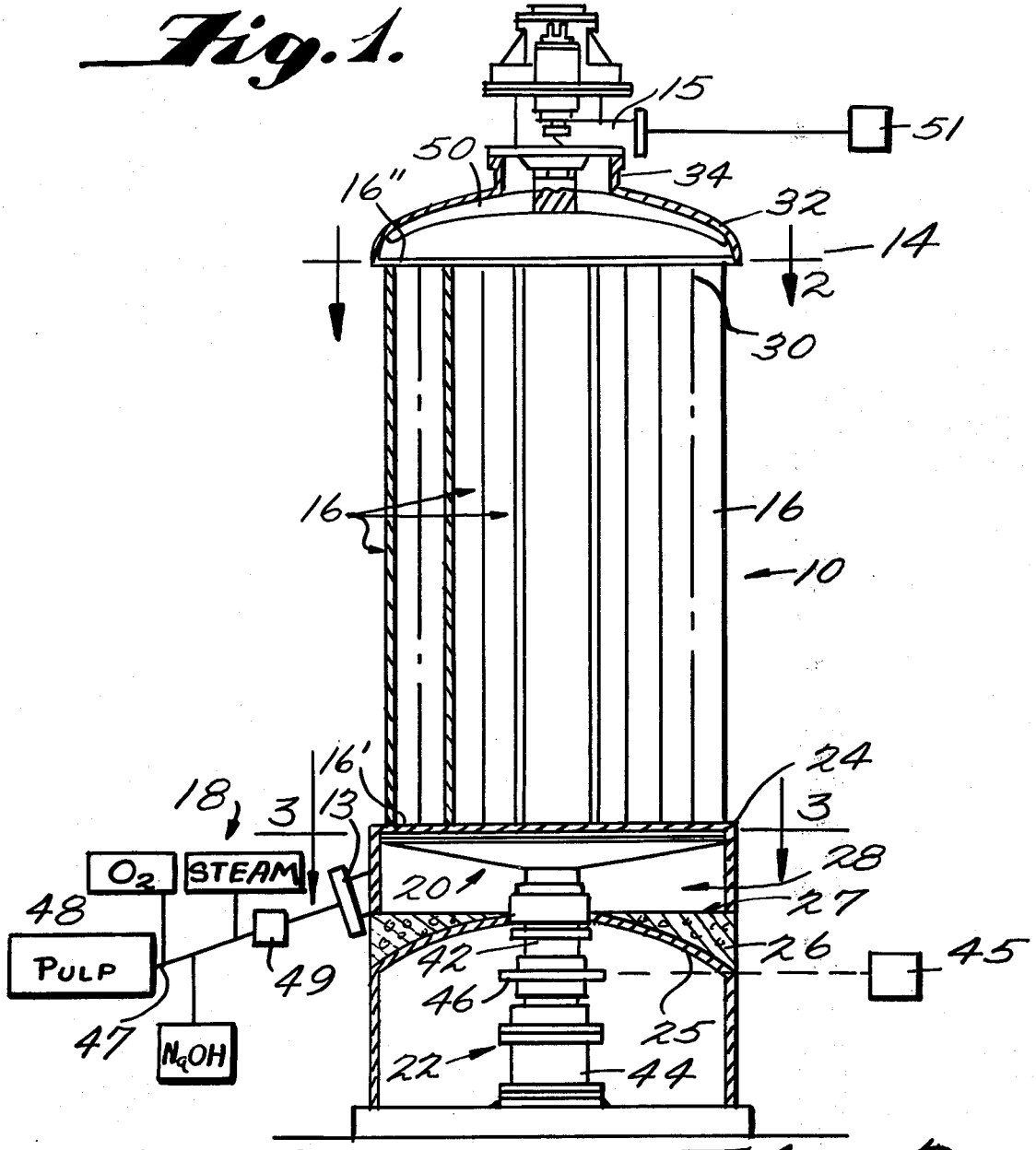
FIG. 1 is a side view, partly in cross-section and partly in elevation, of exemplary oxygen bleaching apparatus according to the present invention.

Exemplary apparatus according to the present invention is shown in FIG. 1, with some portions removed for clarity. The apparatus 10 includes a pressurized first chamber 12 adapted to receive digested cellulosic pulp, including an inlet 13, and a second pressurized chamber 14 and including an outlet 15 for oxygen bleached pulp, with a plurality of discrete generally prismatic hollow members (tubes) 16 in fluid communication and physical contact with the chambers 12 and 14, attached thereto at remote first and second ends 16', 16'' thereof.

Means 18 (of FIG. 4) are provided for adding oxygen bearing fluid to the digested cellulosic pulp, and mixing the oxygen with the pulp. Means 20 selectively provides passage of digested cellulosic pulp mixed with oxygen through at least one of the members 16 from the member second open end 16" to the second chamber 12, while preventing passage of pulp between other of the plurality of members 16 and the second chamber 14. Means 22 are provided for progressively moving the passage providing and blocking means so that it provides communication between each member 16 and the second chamber 14 in turn, so that pulp remains within each member a sufficient time to allow oxygen bleaching thereof without degradation. Such apparatus 10 also essentially eliminates the channelling that can occur in various prior art structures (i.e., U.S. Pat. No. 3,138,947).

The first chamber 12—which is the bottom chamber in the emboodiment shown in FIG. 1—is defined at the upper end thereof by a flat plate 24 or the like, and is defined at the bottom thereof by a pressure sustaining bottom head 25. Fill material 26, such as concrete, may be added above the head 25 to produce a flat surface 27. The plate 24 has a plurality of openings forming therein, each corresponding in cross-sectional shape and cross-sectional area to the hollow ends 16' of the generally prismatic hollow members 16, the members 16 being connected in fluid-tight relationship with the plate 24. A cylindrical sidewall 28 defines the sides of the first chamber 12.

The second chamber 14—which is the top chamber in the embodiment shown in FIG. 1—is defined at the lower end thereof by a flat plate 30, the plate 30 being similar to the plate 24 and having a plurality of openings formed therein for cooperation with the hollow second ends 16" of the members 16, and in fluid communication therewith. A pressure sustaining head 32 defines the top of the second chamber 14, and a collar 34 leads upwardly from the head 32 to the outlet 15. It is thus seen that at least one of the first and second chambers comprises a wall member forming an end wall of the chamber 12, 14 and disposed opposite the connection of the discrete tubular members 16 to the chamber (12, 14), the end wall members formed as a head (25, 32).

Figure 2:
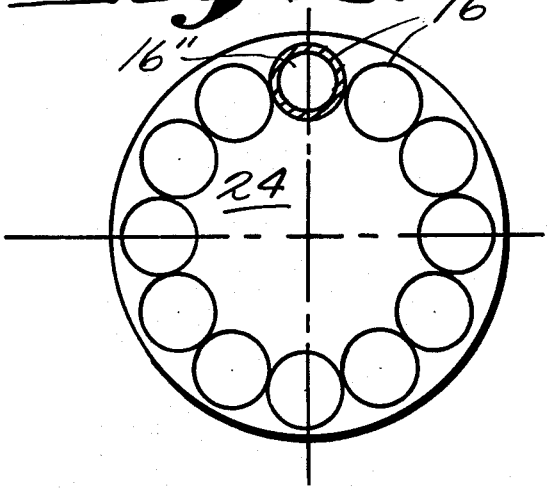
FIG. 2 is a cross-sectional view taken along lines 2—2 of FIG. 1.
Figure 4:
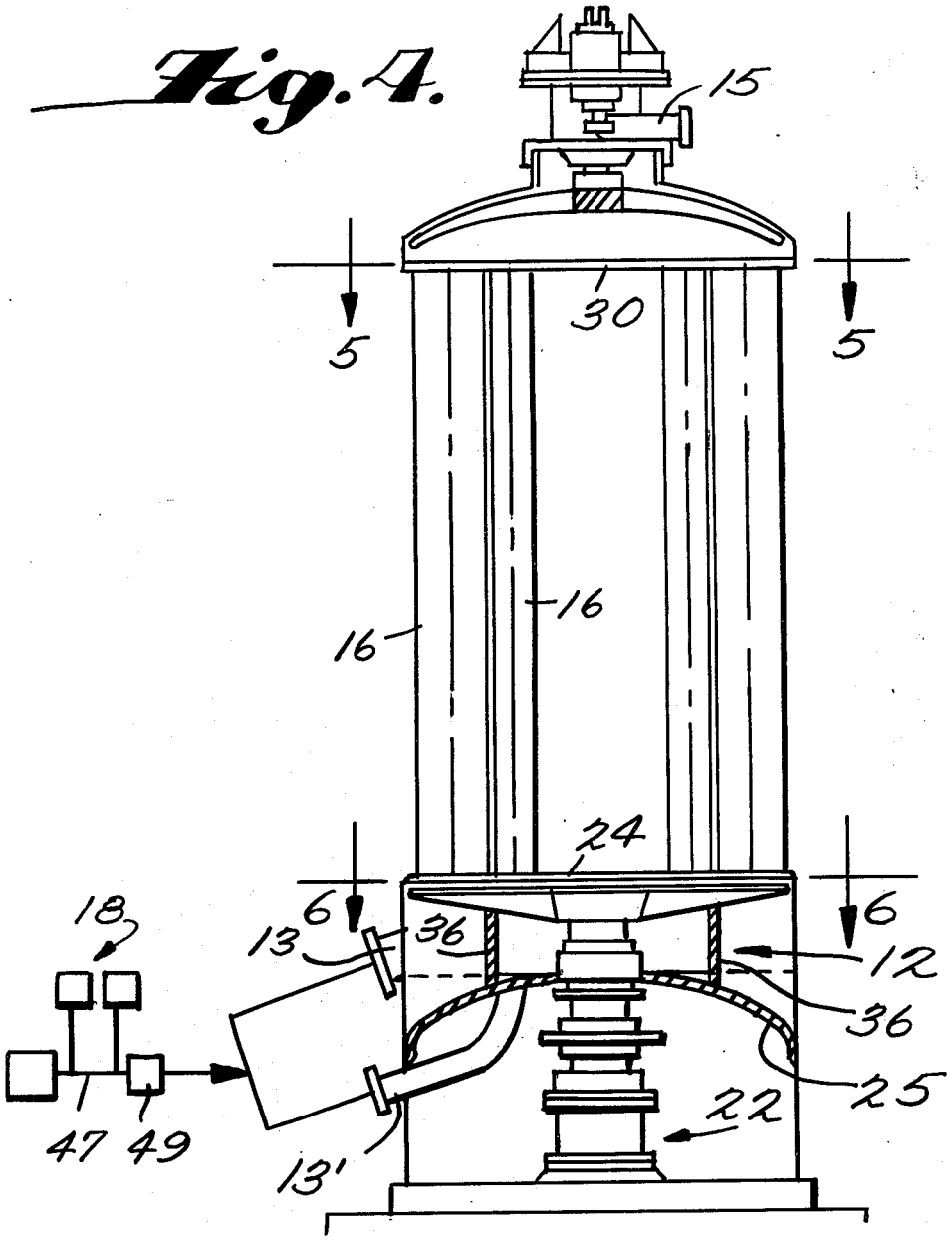
FIG. 4 is a side view, partly in cross-section and partly in elevation of a modified form of exemplary apparatus according to the present invention.
Figure 5:
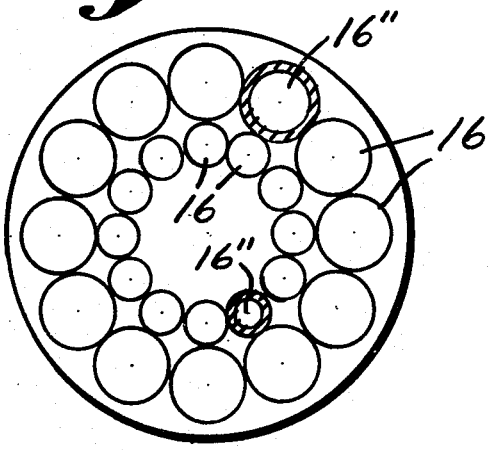
FIG. 5 is a cross-sectional view taken along lines 5—5 of FIG. 4.
Figure 6:
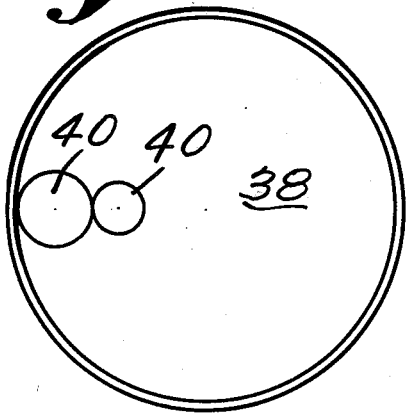
FIG. 6 is a cross-sectional view taken along lines 6—6 of FIG. 4.

Preferably, each of the discrete tubular members 16 is circular in cross-section so that it can readily bear the forces applied by the pressurized pulp flowing therethrough. For efficiency, the members 16 preferably are disposed in a circle as shown in FIG. 2. If desired, the members 16 may be provided in a plurality of concentric circles such as shown in FIGS. 4 through 6. When the members 16 are disposed in a plurality of circles as shown in FIGS. 4 through 6, divider means 36 preferably are provided for dividing the first chamber 12 into a plurality of concentric chambers, one for each circle of members 16, a separate inlet being provided for each concentric chamber (i.e., see inlets 13 and 13' in FIG. 4). The cross-sectional area of each member 16 is significantly less than the cross-sectional area of the first chamber 12, and the cross-sectional areas of members 16 are small enough to play a part in effectively retarding channelling of pulp passing through the members 16.

Figure 3:
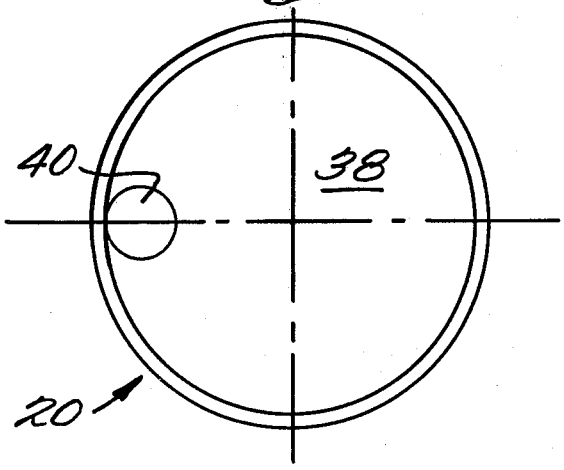
FIG. 3 is a cross-sectional view taken along lines 3—3 of FIG. 1.

The means 20 for selectively providing passage of digested cellulosic pulp mixed with oxygen through at least one of the members 16, while preventing passage of pulp through the others of the plurality of members 16, includes a circular plate 38 (see FIGS. 3 and 6 in particular) having at least one aperture 40 formed therein a substantially the same cross-sectional area and shape as the opening in each of the hollow members 16. As illustrated, the member 20 preferably is exposed in the first chamber 12, although under some circumstances it is also possible to dispose it in the second chamber 14. When a plurality of circular configurations of members 16 are provided—as shown in FIGS. 5 and 6—openings 40 will be provided cooperating with each circular configuration of members 16, as shown in FIG. 6.

The means 22 for progressively moving the passage providing and blocking means 20 so that it provides communication between each member 16 and the second chamber 14 in turn, so that pulp remains within each member sufficient time to allow oxygen-bleaching thereof without degradation, includes a shaft 42 which penetrates the bottom head 25 through a packing bland 43. The lower end of the shaft 42 is mounted in a thrust bearing mechanism 44. Any suitable power source 45 may be provided for rotating the shaft 12. While the shaft 12 may be rotated continuously so that pulp is always flowing through an opening 42 and one or two of the members 16, it is desirable that the shaft is rotated so that the plate 38 with opening(s) 42 therein is indexed from one member 16 to the next so that it moves into true-passage-providing relationship with each member in turn, and moves rapidly between the members 16. This may be accomplished by utilizing a ratchet gear 15 or the like, which allows rotation of shaft 12 in only one direction, and provides for the indexing movement thereof.

The means 18 for adding oxygen bearing fluid to digested cellulose pulp and mixing the oxygen with the pulp includes a line 47 extending from a previous treatment station 48, which may comprise a continuous Kamyr-digester, a storage vessel, or the like. The pulp may be transmitted at digester consistency (i.e., 6 to 15 percent) from the station 48 in the line 47 to inlet 13. Oxygen-bearing gas, steam, and caustic (NaOH) are added to line 47 in any conventional manner from sources thereof, and after addition of the oxygen-bearing gas, etc. to the digested cellulosic pulp it is passed through a mixing means 49 (e.g., defibrator-type) wherein the pulp and gas are intensively mixed together to form a pulp and gas emulsion. In the second chamber 14, a rotating scrapper 50 preferably is provided for facilitating passage of the oxygen bleached pulp from the second chamber 14 into the outlet 15, and then on to a further treatment station 51 where the pulp may be further bleached (i.e., with chlorine), stored or made into paper or the like.

Figure 7:
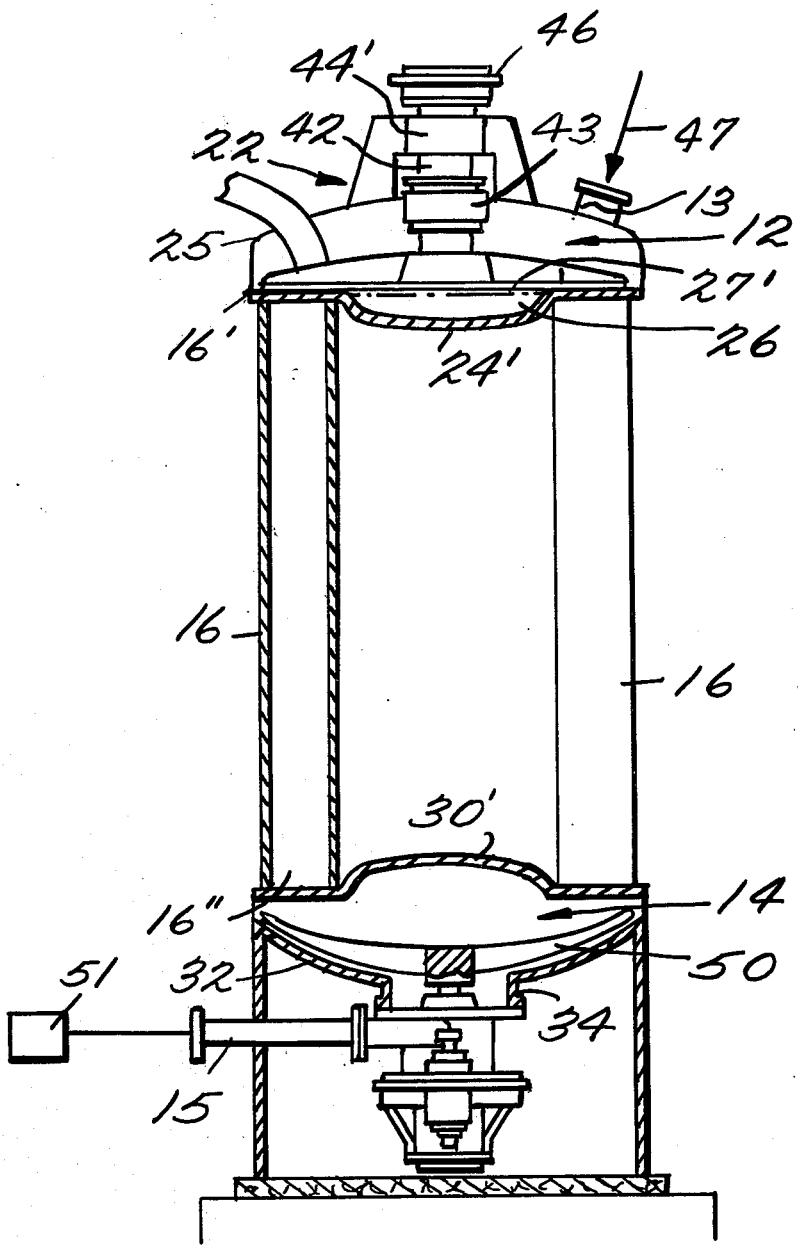
FIG. 7 is a side view of yet another form of apparatus according to the present invention.

In FIGS. 1 through 6, the apparatus 10 is constructed so that the pulp flows upwardly during oxygen bleaching. In the embodiment shown in FIG. 7, the pulp flows downwardly during oxygen bleaching, the first chamber 12 being disposed at the top of the apparatus, and the second chamber 14 being disposed at the bottom thereof. In this arrangement, the structures defining the ends of the chambers 12, 14 which are connected to the members 16 are formed as heads 24', 30', rather than as the more structurally demanding flat plates 24, 30 of the FIGS. 1 and 4 embodiments. The head 24' may be filled with a material such as concrete to 26' to provide a flat upper surface 27' thereof. Thus, the first chamber 12 comprises a wall member forming an end of the chamber 12 and disposed radially inwardly of the circular configuration of discrete tubular members 16 and adjacent an end thereof, and opposite the inlet 13, the wall member being formed as a head 24'; additionally, the second chamber 14 comprises a wall member forming an end of the chamber and disposed radially inwardly of the circular configuration of discrete tubular members 16 and adjacent an end thereof, and opposite the outlet 15, the wall member being formed as a head 30'. The bearing 44' in this embodiment need not be a thrust bearing.

Utilizing the apparatus of FIGS. 1 through 7, a method of oxygen bleaching cellulosic pulp at super atmospheric pressure and temperature may be practiced. The method includes the steps of intermittently mixing oxygen-bearing fluid with digested cellulosic pulp in mixer 49, continuously feeding the pulp under pressure to the first chamber 12, selectively providing communication between the first and second chambers 12, 14 through at least one of the members 14 to allow pulp passage from the member 16 to the second chamber 14, while blocking passage between the second chamber 14 and others of the members 16; progressively changing the at least one member 16 through which pulp passes to the second chamber 14 and the members 16 through which passage is blocked, so that pulp remains within each members sufficient time to allow oxygen-bleaching thereof without degradation, and passes through the members 16 without channelling; and continuously discharging the oxygen bleached pulp from the second chamber 14. The feed and the discharge remain continuous so that the oxygen bleaching is compatiable with other continuous operations, yet the channelling problem encountered in the prior art continuous bleaching systems (i.e., U.S. Pat. No. 3,138,947), and the expensive equipment necessary in other conventional continuous bleaching systems (i.e., U.S. Pat. No. 3,660,225) are avoided.

During practice of the method according to the invention, the pulp and oxygen bearing fluid emulsion in first chamber 12 is pushed by incoming mixer through inlet 13, through opening(s) 40 into a member 16 through the first end 16' thereof, while at the same time reacted pulp is pushed out of the top opening 16' of a member 16 into the pressurized second chamber 14, the chamber 14 being maintaianed pressurized in any conventional manner. Flow of pulp will continue through the member 16 for a predetermined period of time, and then aperture 40 is quickly ratched to the next tube 16 and held in passage-providing communication therewith for the predetermined period of time. IN actuality, a small slug or plug of pulp and oxygen mixture enters the first opening 16' of a tube 16 and moves successively toward the chamber 14 (either upwardly or downwardly) by introduction of a new mixture slug each time the aperture 40 returns to communication with the first opening 16' of that tube 16. The time for the mixture slug to move completely through a tube 16 is the reaction time, and the members 16 bear. the reaction pressure.

It will thus be seen according to the present invention a method and apparatus have been provided which facilitate the oxygen-bleaching of pulp at super-atmospheric pressure and temperature without utilizing the expensive structures and without encountering the channelling problems that exist in the prior art. While the invention has been herein shown and described in each is presently conceived to be the most practical and preferred embodiment thereof, it will be apparent to those of ordinary skill in the art that many modifications may be made thereof within the scope of the invention, which scope is to be accorded the broadest interpretation of the appended claim so as to encompass all equivalent structures and methods.

What is claimed is:

1. A method of oxygen-bleaching cellulosic pulp at super atmospheric pressure and temperature utilizing a first pressurized chamber, a plurality of discrete pressurized tubular members disposed in a circle and in fluid communication and physical contact with said first chamber at one end thereof, and a second pressurized chamber, at least some of the hollow members in fluid communication and physical contact with the second chamber at the other ends thereof, the cross-sectional areas of all of the tubular members being less than the cross-sectional area of the first chamber or the second chamber; and a circular plate having at least one aperture formed therein of substantially the same cross-sectional area and shape of each of the tubular members;

intimately mixing oxygen-bearing fluid with digested cellulosic pulp, continuously feeding the pulp under pressure to the first chamber, selectively providing communication between the first and second chambers through at least one of the members to allow pulp passage from the first chamber through the member to displace pulp from the member to the second chamber, while blocking passage between others of the members and the second chamber.

progressively changing the at least one member through which pulp passes to the second chamber and the members through which passage is blocked, so that pulp remains within each member sufficient time to allow oxygen-bleaching thereof without degradation, and passes through the members without channelling, by rotating the apertured circular plate to return the at least one aperture in the circular plate to each member to allow plugs of pulp to successively travel through each member as new plugs are introduced into each member, and continuously discharging the oxygen-bleached pulp from the second chamber as it is displaced therefrom by pulp slugs from the members.

2. A method as recited in claim 1 wherein said pulp has a consistency of about 6–15%.

3. A method as recited in claim 1 wherein pulp passage between the first and second chambers is vertically upwardly.

4. A method as recited in claim 1 wherein pulp passage between the first and second chambers is vertically downwardly.

5. Oxygen bleaching apparatus comprising a pressurized first chamber adapted to receive digested cellulosic pulp, and including an inlet for digested cellulosic pulp, means for adding oxygen bearing fluid to the digested cellulosic pulp, and means for mixing the oxygen with the pulp, a plurlaity of discrete pressurized tubular members each having first and second ends, and each in fluid communication and physical contact at the first end thereof with the first chamber, and extending therefrom, said members disposed in a circle, a pressurized second chamber adapted to receive pulp therin, said second chamber being in fluid communication and physical contact with at least some of said members at the second ends therof, said second chamber including an otulet for oxygen bleached pulp, the cross-sectional areas of all of the tubular members being less than the cross-sectional area of the first chamber or the second chamber, means distinct from said first chamber inlet for selectively providing passage of digested cellulosic pulp mixed with oxygen through at least one of said members from said at least one member to said second chamber while blocking passage of pulp between others of said plurality of members and said second chamber said passage providing and blocking means comprising a generally circular plate having at least one aperture formed therin of substantially the same cross-sectional area and shape of each of said members, and means for rotating said passage providing and blocking means so that it allows pulp passage from said first chamber through each member in turn to displace pulp from each member in turn to said second chamber, and so that pulp remains within each member sufficient time to allow oxygen-bleaching thereof without degradation, said rotating means returning as at least one aperture in said circular plate to each member to allow plugs of pulp to successively travel through each member as new plugs are introduced into each member.

6. Apparatus as recited in claim 5 wherein each of said members extend vertically upwardly from said first chamber to said second chamber.

7. Apparatus as recited in claim 5 wherein each of said members extends vertically downwardly from said first chamber to said second chamber.

8. Apparatus as recited in claim 5 wherein said rotating means comprises means for rotating said passage providing and blocking means in only one direction.

9. Apparatus as recited in claim 8 wherein said rotating means further comprises means for indexing said passage providing and blocking means so that it moves into true passage providing relationship with each member in turn and moves rapidly between members.

10. Apparatus as recited in claim 5 wherein said members discrete tubular are arranged in a plurality of concentric circles.

11. Apparatus as recited in claim 10 further comprising divider means for dividing said first chamber into a plurality of concentric chambers, one for each circle of members, a separate inlet being provided for each concentric chamber.

12. Apparatus as recited in claim 5 wherein said passage providing and blocking means is disposed in said first chamber.

13. Apparatus as recited in claim 5 wherein said first chamber comprises a wall member forming an end of said chamber and disposed radially inwardly of said circular configuration of discrete tubular members and adjacent an end thereof, and opposite said inlet, said wall member being formed as a head.

14. Apparatus as recited in claim 5 wherein at least one of said first and second chambers comprises a wall member forming an end wall of said chamber and disposed opposite the connection of said discrete tubular members to said chamber, said opposite end wall member formed as a head.

15. Apparatus as recited in claim 14 wherein said first chamber head has fill material disposed therein so that said chamber presents a flat interior contour adjacent said opposite end wall.

16. Apparatus as recited in claim 5 further comprising rotating scrapper means disposed in said second chamber for facilitating passage of oxygen-bleached pulp from said second chamber into said outlet.

17. Apparatus as recited in claim 5 wherein each of said members discrete tubular is substantially circular in cross-section.

18. Apparatus as recited in claim 5 wherein the cross-sectional area of each of said members is small enough to effectively retard channelling through said members.

19. Apparatus as recited in claim 5 wherein said second chamber comprises a wall member forming an end of said chamber and disposed radially inwardly of said circular configuration of discrete tubular members and adjacent an end thereof, and opposite said outlet, said wall member being formed as a head.

20. In oxygen bleaching apparatus comprising a pressurized first chamber adapted to receive digested cellulosic pulp, and including an inlet for digested cellulosic pulp; means for adding oxygen bearing fluid to the digested cellulosic pulp, and means for mixing the oxygen with the pulp; a plurality of discrete pressurized tubular members each having first and second ends, and each in fluid communication and physical contact at the first end thereof with the first chamber, and extending therefrom; a pressurized second chamber adapted to receive pulp therein, said second chamber being in fluid communication and physical contact with at least some of said members at said second ends thereof, said second chamber including an outlet for oxygen bleached pulp; at least one of the first and second chambers comprising a wall member forming an end wall of the chamber and disposed opposite the connection of said discrete tubular members to the chamber, said opposite end wall member formed as a head; the cross sectional areas of all of the tubular members being less than the cross sectional area of the first chamber or the second chamber; means distinct from the first chamber inlet for selectively providing passage of digestive cellulosic pulp mixed with oxygen through at least one of said members from said at least one member to said second chamber while blocking passage of pulp between others of said plurality of members and said second chamber; means for progressively moving said passage providing and blocking means so that it allows pulp passage from said first chamber through each member in turn to displace it from each member in turn to said second chamber, so that pulp remains within each chamber sufficient time to allow oxygen bleaching thereof without degradation, allowing plugs of pulp to successively travel through each member as new plugs are introduced into each member; and said first chamber head has fill material disposed therein so that said chamber presents a flat interior contour adjacent said opposite end wall.

21. In oxygen bleaching apparatus comprising a pressurized first chamber adapted to receive digested cellulosic pulp, and including an inlet for digesting cellulosic pulp; means for adding oxygen bearing fluid to the digested cellulosic pulp, and means for mixing the oxygen with the pulp; a plurality of discrete pressurized tubular members each having first and second ends, and each in fluid communication and physical contact at the first ends thereof with the first chamber, and extending therefrom, said members disposed in a circle; a pressurized second chamber adapted to receive pulp therein, said second chamber being in fluid communication and physical contact with at least some of said members at the second ends thereof, said second chamber including an outlet for oxygen bleached pulp; the cross-sectional areas of all of the tubular members being less than the cross-sectional areas of the first chamber or the second chamber; means distinct from the first chamber inlet for selectively providing passage of digested cellulosic pulp mixed with oxygen through at least one of said members from said at least one member to said second chamber while blocking passage of pulp between others of said plurality of members and said second chamber,: means for rotating said passage providing and blocking means so that it allows pulp passage from said first chamber through each member in turn to displace pulp from each member in turn to said second chamber and so that pulp remains with each member sufficent time to allow oxygen bleaching thereof without degradation, allowing plugs of pulp to successively travel through each member as new plugs are introduced into each member; and said first chamber comprising a wall member forming an end of said chamber disposed radially inwardly of said circular configuration of discrete tubular members and adjacent an end thereof, and opposite said inlet said wall member being formed as a head.

22. In oxygen bleaching apparatus comprising a pressurized first chamber adapted to receive digested cellulosic pulp, and including an inlet for digested cellulosic pulp; means for adding oxygen bearing fluid to the digested cellulosic pulp, and means for mixing the oxygen with the pulp; a plurality of discrete pressurized tubular members each having first and second ends, and each in fluid communication and physical contact at the first ends thereof with the first chamber, and extending therefrom, said members disposed in a circle; a pressurized second chamber adapted to receive pulp therein, said second chamber being in fluid communication and physical contact with at least some of said members at the second ends thereof, said second chamber including an outlet for oxygen bleached pulp, the cross-sectional areas of all of the tubular members being less than the cross-sectional areas of the first chamber or the second chamber; means distinct from the first chamber inlet for selectively providing passage of digested cellulosic pulp mikxed with oxygen through at least one of said members from said at least one members to said second chamber while blocking passage of pulp between others of said plurality of members and said second chamber; means for rotating said passage providing and blocking means so that it allows pulp passage from said first chamber through each member in turn to displace pulp from each member in turn to said second chamber and so that pulp remains within each member sufficient time to allow oxygen bleaching thereof without degradation, allowing plugs of pulp to successively travel through each member as new plugs are introduced into each member; and said second chamber comprising a wall member forming an end of said chamber and disposed radially inwardly of said circular configuration of discrete tubular members and adjacent an end thereof, and opposite said outlet, said wall member being formed as a head.

* * * * *